United States Patent [19]

Hirakawa et al.

[11] Patent Number: 4,631,109

[45] Date of Patent: Dec. 23, 1986

[54] SINGLE FACER

[75] Inventors: Tadashi Hirakawa; Kiyomitsu Yoshikawa; Shigenari Yoshioka; Hiroaki Sasashige, all of Mihara, Japan

[73] Assignee: Mitsubishi Jukogyo Kabushiki Kaisha, Tokyo, Japan

[21] Appl. No.: 666,376

[22] Filed: Oct. 30, 1984

[30] Foreign Application Priority Data

Nov. 10, 1983 [JP] Japan ..... 58-211417

[51] Int. Cl.[4] ..... B31F 1/28

[52] U.S. Cl. ..... 156/472; 156/210; 425/369

[58] Field of Search ..... 156/205–210, 156/462, 470, 471, 472, 473; 29/121.5, 121.1; 425/369, 388, 396; 264/286

[56] References Cited

U.S. PATENT DOCUMENTS 3,455,767 7/1969 Meister ..... 156/473 X 3,919,029 11/1975 Osgood ..... 156/210 X 3,994,768 11/1976 Roberts ..... 156/473

*Primary Examiner*—Edward Kimlin

*Assistant Examiner*—Ramon R. Hoch

*Attorney, Agent, or Firm*—Wenderoth, Lind & Ponack

[57] ABSTRACT

A single facer of the type wherein a core paper sheet is corrugated by means of a pair of upper and lower corrugated rolls and has its crest portions applied with paste, and then a liner introduced from a different direction is pasted on the corrugated core sheet while passing between the lower corrugated roll and a pressure roll to form a single-faced corrugated sheet, is improved in that at least one pair of additional upper and lower corrugated rolls having a different shape of corrugation from first mentioned pair of upper and lower corrugated rolls are supported on a rotatable frame jointly with the first pair of upper and lower corrugated rolls, and structure for rotating the rotatable frame is provided.

1 Claim, 4 Drawing Figures

SINGLE FACER

BACKGROUND OF THE INVENTION

The present invention relates to a single facer for making a single-faced corrugated sheet, and more particularly to a single facer of the type wherein a core paper sheet is corrugated by means of a pair of upper and lower corrugated rolls and has its crest portions applied with paste and then a liner introduced from a different direction is pasted on the corrugated core sheet while passing between the lower corrugated roll and a pressure roll to form a single-faced corrugated sheet.

At first, description will be made of a single-facer known in the prior art with reference to FIG. 1 which shows one example of the known single-facer of the above-mentioned type. In this figure, a core paper sheet 4 is introduced to a meshing point between an upper corrugated roll 1 and a lower corrugated roll 2 both of which have their circumferential surfaces machined into a corrugated configuration, and thereby the core paper sheet 4 is worked into a corrugated shape. Subsequently, the corrugated core paper sheet has its crest portions applied with paste by means of a paste application roll 7, and then it is urged against a liner 5 introduced to the single facer from a different direction and also is heated at an engaging portion between the lower corrugated roll 2 and a pressure roll 3. Thereby a single-faced corrugated sheet 8 is formed.

In addition, in the structure shown in FIG. 1, the upper corrugated roll 1 is mounted on an arm 9 via a bearing not shown. This arm 9 has one end swingably mounted on a frame 11 via a pivot pin 10, and has the other end connected to a rod of a cylinder 13 which is connected to a bracket 12 fastened to the frame 11. Also, the lower roll 2 is mounted on the frame 11 and the bracket 12 via a bearing not shown.

Owing to the above-described structure, the urging force between the upper corrugated roll 1 and the lower corrugated roll 2 which is necessitated for shaping the core paper sheet 4 into a corrugated shape, is obtained by the driving force of the cylinder 13. Within the upper corrugated roll 1, lower corrugated roll 2 and pressure roll 3 are respectively provided hollow spaces so that steam can be introduced into these hollow spaces for the purpose of promoting shaping of the core paper sheet 4 into a corrugated shape and pasting of the corrugated paper sheet with the liner 5.

A cross-section of a corrugated cardboard sheet is illustrated in FIG. 2. Generally, corrugated cardboard sheets are classified depending upon the shape of corrugation into A, B, C and E flute classes, which have respectively different heights H and different pitches P (See FIG. 2) of corrugation, and which are selectively employed depending upon uses.

However, in the single facer in the prior art, in the case of replacing the corrugated rolls for the purpose of making corrugated cardboard sheets of different classes, it is necessary to disassemble the bracket 12, pivot pin 10, steam pipings, etc. as shown in FIG. 1. It also is necessary to delay the replacement operation until the corrugated rolls and peripheral component parts, which have been held at a high temperature by the introduced steam during the previous corrugating operation, have cooled to a satisfactorily low temperature. Therefore, a replacement period of one to two days was necessitated. Due to the necessity of this replacement period, it was a common practice in the prior art that normally one single facer can make only one class of corrugated cardboard sheets.

SUMMARY OF THE INVENTION

It is therefore one object of the present invention to provide a novel single facer which is free from the above-mentioned shortcomings of the single facer of the prior art.

A more specific object of the present invention is to provide a novel single facer in which replacement of corrugated roll pairs having different shapes of circumferential corrugation can be achieved quickly in order to be adapted for various classes of corrugated cardboard sheets.

According to one feature of the present invention, there is provided a single facer of the type wherein a core paper sheet is corrugated by means of a pair of upper and lower corrugated rolls having a corrugated circumferential configuration, the corrugated core paper sheet has its crest portions applied with paste, and then a liner introduced to the single facer from a different direction is pasted on the corrugated paper sheet while passing between the lower corrugated roll and a pressure roll to form a single-faced corrugated sheet, which single facer comprises a rotatable frame for supporting the pair of upper and lower corrugated rolls, means for rotating the rotatable frame, and at least one pair of additional upper and lower corrugated rolls also supported from the rotatable frame and having a different shape of circumferential corrugation from that of the first-mentioned pair of upper and lower corrugated rolls.

Owing to the above-featured structure, the single facer according to the present invention can arbitrarily produce corrugated cardboard sheets of different classes having different shapes of corrugation by merely rotating the rotatable frame.

BRIEF DESCRIPTION OF THE DRAWINGS

The above-mentioned and other objects, features and advantages of the present invention will become more apparent by reference to the following description of one preferred embodiment of the invention taken in conjunction with the accompanying drawings, wherein.

DETAILED DESCRIPTION OF THE INVENTION

Figure 1:
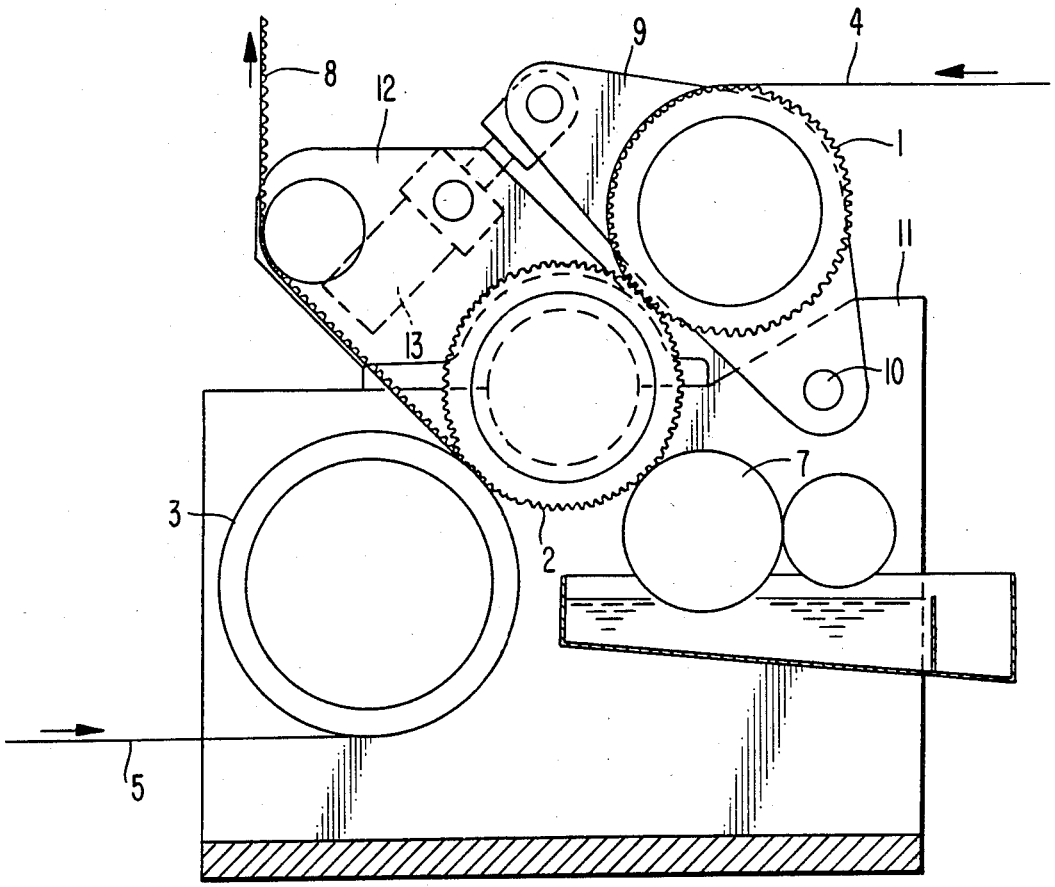
FIG. 1 PRIOR ART
FIG. 1 is a cross-section front view of a single facer in the prior art.
Figure 2:
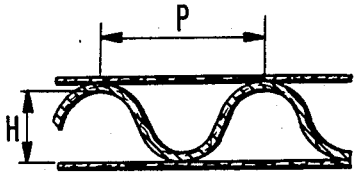
FIG. 2 is a partial cross-section view of a corrugated cardboard sheet.
Figure 3:
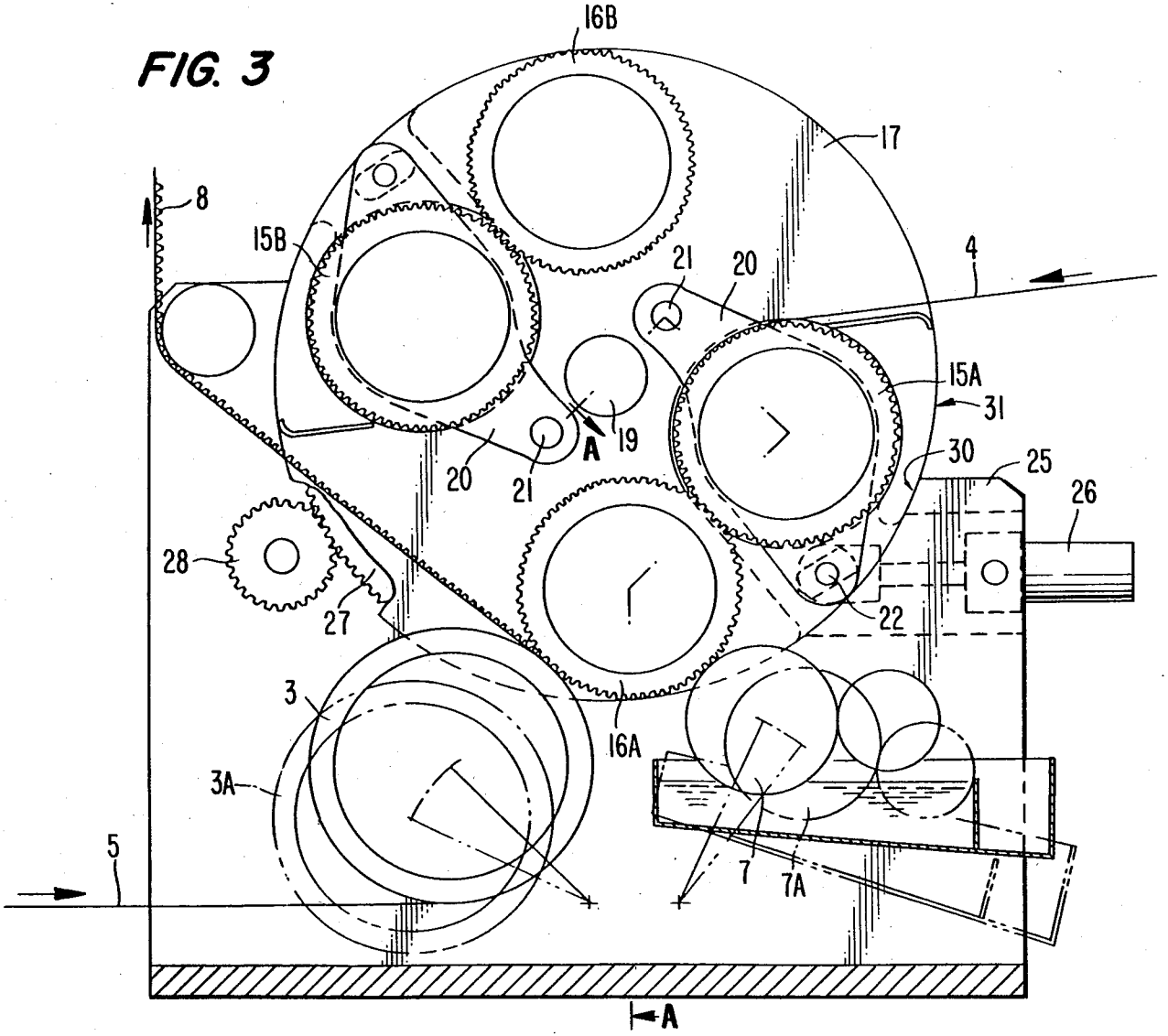
FIG. 3 is a cross-section front view of a single facer according to one preferred embodiment of the present invention.
Figure 4:
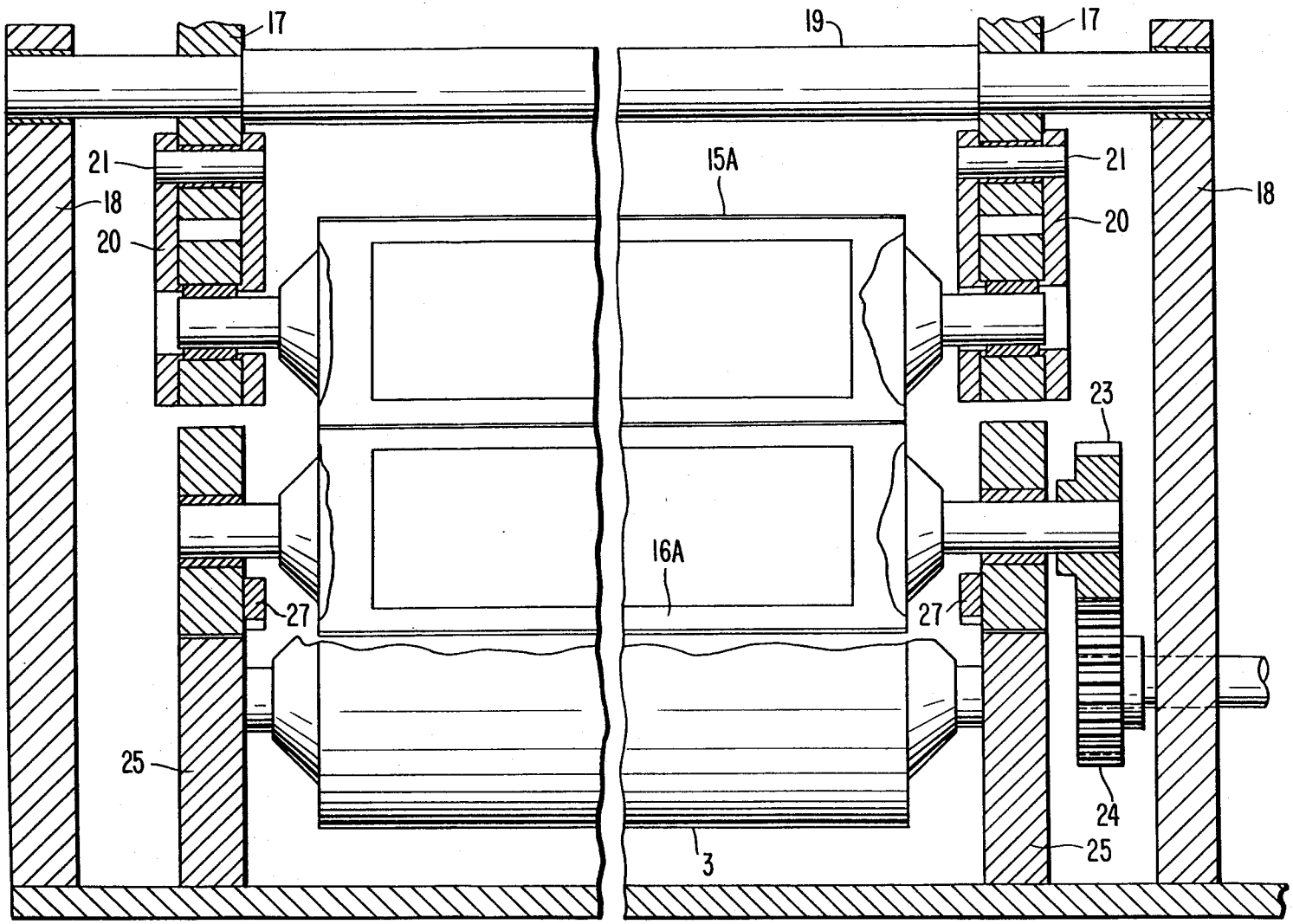
FIG. 4 is a cross-section view taken along line A—A in FIG. 3.

Referring now to FIGS. 3 and 4 of the accompanying drawings which illustrate one preferred embodiment of the present invention, a lower corrugated roll 16A and another lower corrugated roll 16B are mounted on a rotatable frame 17 via bearings not shown, and at one end of the shaft of each of the corrugated rolls 16A and 16B is mounted a gear 23. This gear 23 meshes with a gear 24 at one end of a shaft of a main driving device (not shown). An upper corrugated roll 15A and another upper corrugated roll 15B are mounted on respective arms 20 via bearings not shown, and one end of each of the arms 20 is pivotably mounted on the rotatable frame 17 via a pivot pin 21. On the other hand, the other ends of the respective arms 20 are adapted to be coupled to a rod of a cylinder 26 via a pin 22, which cylinder 26 is swingably mounted on a fixed frame 25, but actually only one of the arms 20 is coupled to the rod of the cylinder 26.

The rotatable frame 17 is fixedly secured to a support shaft 19 which is rotatably supported from side frames 18 via bearings (See FIG. 4), and the rotatable frame 17 can rotate with its outer circumferential surface 31 sliding along a concave surface 30 at the edge of the fixed frame 25 (See FIG. 3). In addition, on one side of the rotatable frame 17 is mounted a gear 27 which is adapted to mesh with a gear 28 rotatably mounted on the fixed frame 25 as shown in FIG. 3. The gear 28 is fixed on a shaft coupled to a driving device (not shown). In this construction, steam pipings, hydraulic or pneumatic pipings and oil feed pipings have such lengths that the rotatable frame 17 can be rotated with these pipings kept connected to the rotatable frame 17. It is to be noted that the structure of a pressure roll 3, a paste application roll 7 and members associated therewith is identical to the structure of the same members in the single facer of the prior art. While description has been made above in connection to a preferred embodiment in which two pairs of upper and lower corrugated rolls are provided, the above-described novel structure is equally applicable to a single facer provided with three or more pairs of upper and lower corrugated rolls.

Explaining now the operation of the above-described single facer according to the present invention, the fabrication process of a single-faced corrugated sheet is quite the same as that in the prior art. That is, a core paper sheet 4 is worked into a corrugated sheet by means of the upper corrugated roll 15A and the lower corrugated roll 16A, the corrugated paper sheet has its crest portions applied with paste by means of the paste application roll 7, and then it is urged against a liner 5 introduced to the single facer from a different direction and heated up by means of the lower corrugated roll 16A and the pressure roll 3, whereby a single-faced corrugated sheet is fabricated.

In the case of replacing the upper and lower corrugated rolls 15A and 16A under operation by another pair of upper and lower corrugated rolls 15B and 16B having a different shape of corrugation, at first the pressure roll 3 and the paste application roll 7 are lowered to the positions 3A and 7A, respectively, shown by double-dot chain lines by means of a known mechanism. Then, the pin 22 is extracted and the gear 28 is driven so that the rotatable frame 17 is rotated by 180° in the case of the illustrated embodiment, and as a result, the corrugated rolls 15B and 16B are moved to the positions of the corrugated rolls 15A and 16A shown in FIG. 3. If the pin 22 is again inserted after the rotation of the rotatable frame 17 has been stopped, then the single facer is brought into the condition where fabrication of a single-faced corrugated sheet by means of the corrugated rolls 15B and 16B having the different shape of corrugation is possible.

In contrast to the fact that in the single facer of the prior art, for the purpose of carrying out replacement of corrugated rolls, operations such as disassembly of various component parts, unloading and loading (assembling) of corrugated rolls and the like were necessitated, according to the present invention the corrugated rolls can be replaced without necessitating any such operations. Hence, the replacement period can be shortened greatly, and thereby single-faced corrugated sheets having different shapes of corrugation can be arbitrarily fabricated by means of one single facer.

Since many changes and modifications can be made to the above-described construction without departing from the spirit of the present invention, it is intended that all matter contained in the above description and illustrated in the accompanying drawings shall be interpreted to be illustrative and not as a limitation to the scope of the invention.

What is claimed is:

1. In a single facer of the type wherein a core paper sheet introduced in a first direction is corrugated by means of a pair of upper and lower corrugated rolls, said rolls having a corrugated circumferential configuration, the corrugated core paper sheet has its crest portions applied with paste, and then a liner introduced to said single facer from a second direction different from said first direction is pasted on the corrugated paper sheet while passing between said lower corrugated roll and a pressure roll to form a single-faced corrugated sheet, the improvement wherein:

said single facer comprises a rotatable frame supporting said pair of upper and lower corrugated rolls; and at least one pair of additional upper and lower corrugated rolls also is supported from said rotatable frame and has a different shape of circumferential corrugations from that of said first mentioned pair of upper and lower corrugated rolls; and means for rotating said rotatable frame for bringing a selected said pair of corrugated rolls into operative position with said pressure roll for performing a corrugating operation.

* * * * *